US006631968B2

(12) United States Patent
Tang et al.

(10) Patent No.: US 6,631,968 B2
(45) Date of Patent: Oct. 14, 2003

(54) METHOD AND DEVICE FOR SPEEDING UP A PRINTING PROCESS

(75) Inventors: Chien-Hsing Tang, Taipei (TW); Chia-Lei Yu, Ping-Cheng (TW); Chien-Hsien Ho, I-Lan (TW)

(73) Assignee: Benq Corporation, Taoyuan (TW)

( * ) Notice: Subject to any disclaimer, the term of this patent is extended or adjusted under 35 U.S.C. 154(b) by 41 days.

(21) Appl. No.: 09/683,198

(22) Filed: Nov. 29, 2001

(65) Prior Publication Data

US 2002/0067385 A1 Jun. 6, 2002

(30) Foreign Application Priority Data

Dec. 1, 2000 (TW) ..... 89125539 A

(51) Int. Cl.[7] ..... B41J 29/393
(52) U.S. Cl. ..... 347/19; 347/14; 347/37
(58) Field of Search ..... 347/19, 37, 14, 347/12, 10, 11, 23, 30, 104, 8, 15, 16, 17; 400/279, 323, 708

(56) References Cited

U.S. PATENT DOCUMENTS 5,142,374 A * 8/1992 Tajika et al. ..... 358/298
5,627,947 A 5/1997 Chan et al.
5,751,305 A * 5/1998 Hadley ..... 347/19
5,798,773 A * 8/1998 Hiramatsu et al. ..... 347/19
6,120,142 A 9/2000 Eltgen et al.

FOREIGN PATENT DOCUMENTS

JP 2080276 3/1990

* cited by examiner

*Primary Examiner*—Lamson Nguyen
*Assistant Examiner*—Charles W. Stewart, Jr.
(74) *Attorney, Agent, or Firm*—Winston Hsu

(57) ABSTRACT

A printing device includes a print unit for printing data. In each printing procedure, the printer separates at least a printing division from a path that the print unit passes through in the printing procedure and determines if the path includes a non-printing division according to the print data. The printer controls the print unit to move at a first velocity and print the document when the print unit passes through the printing division. If the path includes a non-printing division, the printer controls the print unit to stop printing the document and to move at a second velocity within the non-printing division when the print unit passes through the non-printing division.

15 Claims, 8 Drawing Sheets

METHOD AND DEVICE FOR SPEEDING UP A PRINTING PROCESS

BACKGROUND OF INVENTION

1. Field of the Invention

The present invention relates to a method and a device for increasing the speed of a printing process, and more particularly, to a method for increasing the speed of a printing process while maintaining the quality of printing.

2. Description of the Prior Art

Please refer to FIG. 1 to FIG. 3. FIG. 1 is a perspective view of a printing device 10 according to the prior art. FIG. 2 is a top view of the printing device 10 shown in FIG. 1. FIG. 3 is a relationship diagram showing the velocity dependence on position of a print head 12 of the printing device 10. The printing device 10 comprises a print head 12 for printing a document 14 in the print path 16. The print head 12 goes left and right in the X-direction when the printing device 10 prints the document 14. Please refer to FIG. 2, the print head 12 goes left and right between position A and position E to perform a plurality of printing procedures, and prints a document 14 in the print path 16 (between position B and position D). The print head 12 is designed to move at a constant velocity so that the print quality remains constant.

For convenience of illustration and comparison with the present invention, the print path 16 is divided into two divisions, a printing division 17 and a non-printing division 19 as shown in FIG. 2. The printing division 17 indicates a portion of the path 16 in which the print head does a printing action, meaning that the print head injects ink on a paper. The non-printing division 19 is a portion that excludes the printing division from the print path 16. As shown in FIG. 3, the print head 12 moves at a constant velocity (velocity I) in both the printing division 17 and the non-printing division 19 according to this prior art. For this reason, the printing device 10 according to the prior art prints at an unsatisfactorily slow rate.

SUMMARY OF INVENTION

It is therefore a primary objective of the claimed invention to provide a method and a device for speeding up a printing process. According to the claimed invention, a print unit moves at a first velocity within a printing division, but moves at a higher velocity within a non-printing division if the non-printing division is included in the print path.

The claimed invention provides a method and a device for speeding up a printing process. The claimed invention includes a printing device for performing a plurality of printing procedures according to print data so as to print a document. The printing device has a print unit for printing the document in a left-and-right direction, a motor for driving the print unit left and right, and a control unit for controlling the velocity of the print unit. Before the printing device performs each of the printing procedures, the control unit separates a printing division from a path that the print unit passes through in the printing procedure and determines if the path includes a non-printing division according to the print data. When the print unit passes through the printing division, the print unit prints the document and moves at a first velocity. When the print unit passes through the non-printing division, the print unit stops printing the document and the control unit controls the print unit to move at a second velocity within the non-printing division.

It is an advantage of the claimed invention that the print unit moves at the first velocity within the printing division, and moves at the higher velocity within the non-printing division if the non-printing division is included in the print path. Therefore, not only is the printing process sped up, but the quality of the printing is also assured.

These and other objectives of the present invention will no doubt become obvious to those of ordinary skill in the art after reading the following detailed description of the preferred embodiment, which is illustrated in the various figures and drawings.

DETAILED DESCRIPTION

Figure 1:
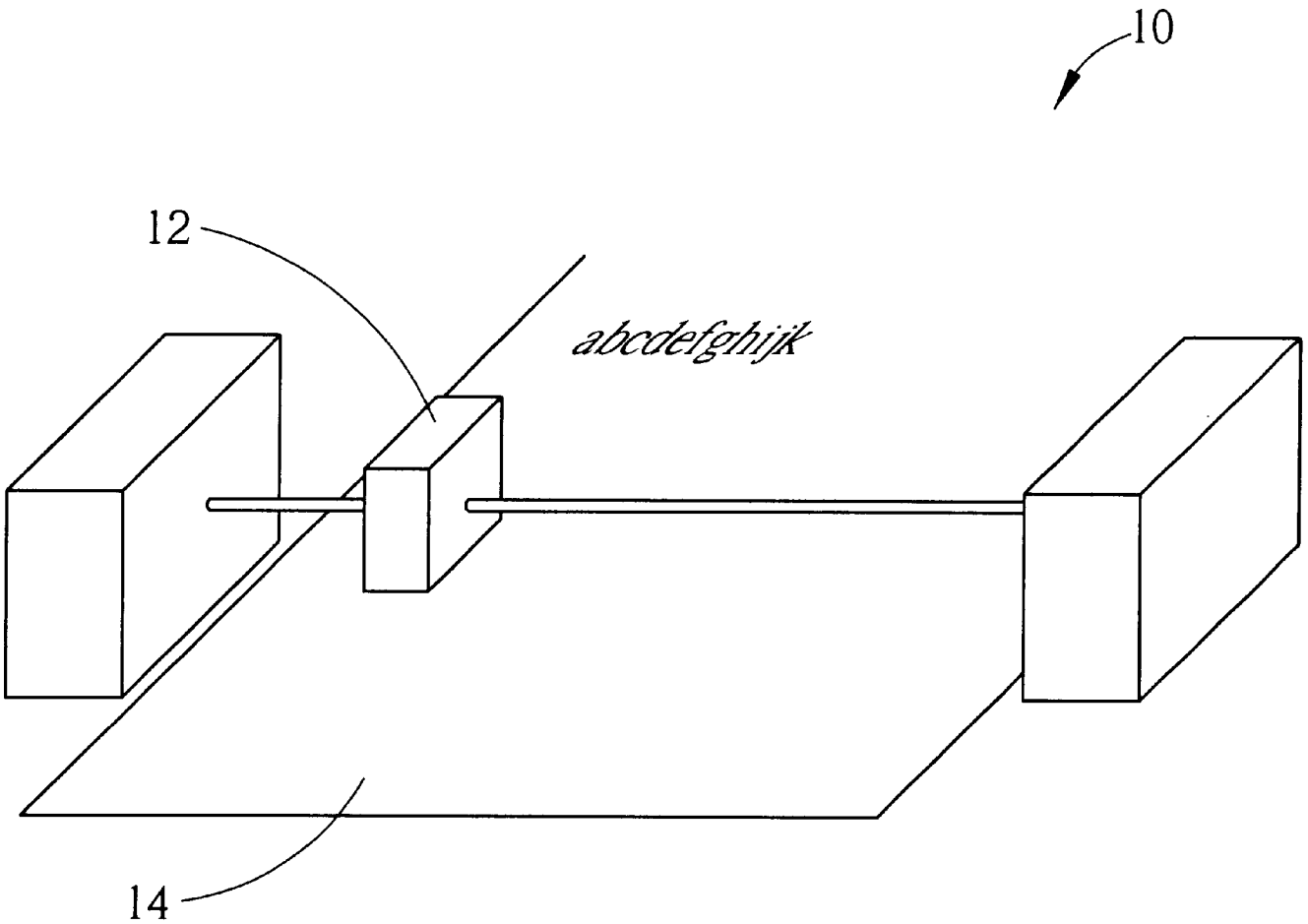
Fig. 1 Prior art
FIG. 1 is a perspective view of a printing device according to a prior art.
Figure 2:
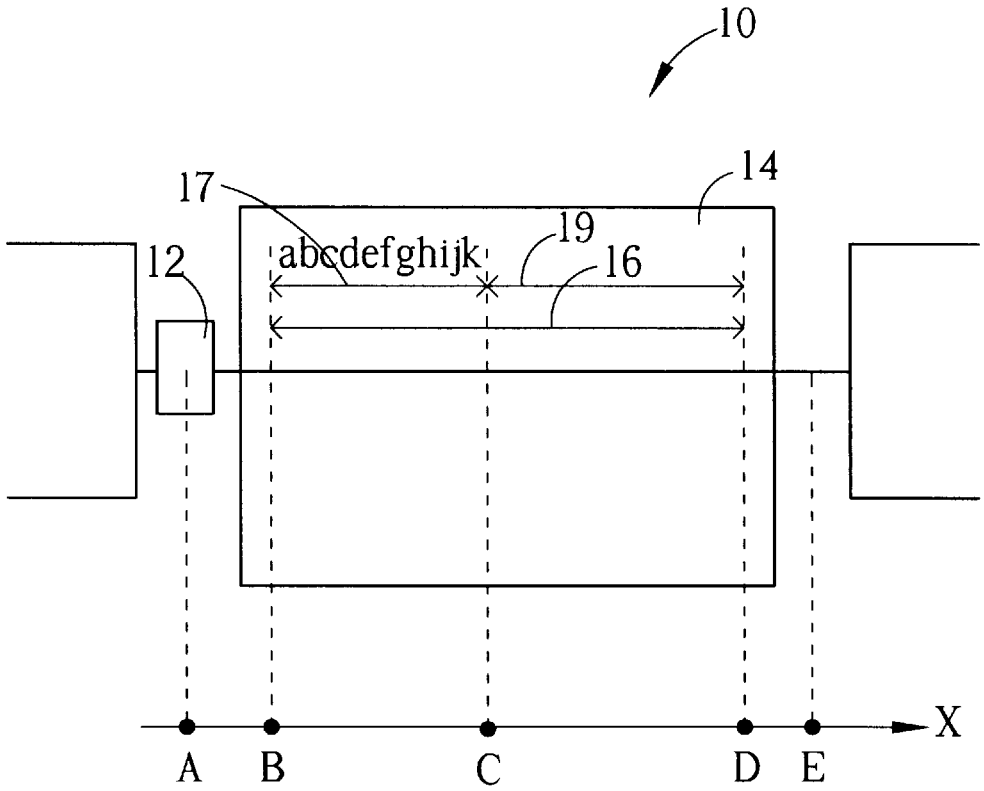
Fig. 2 Prior art
FIG. 2 is a top view of the printing device shown in FIG. 1.
Figure 3:
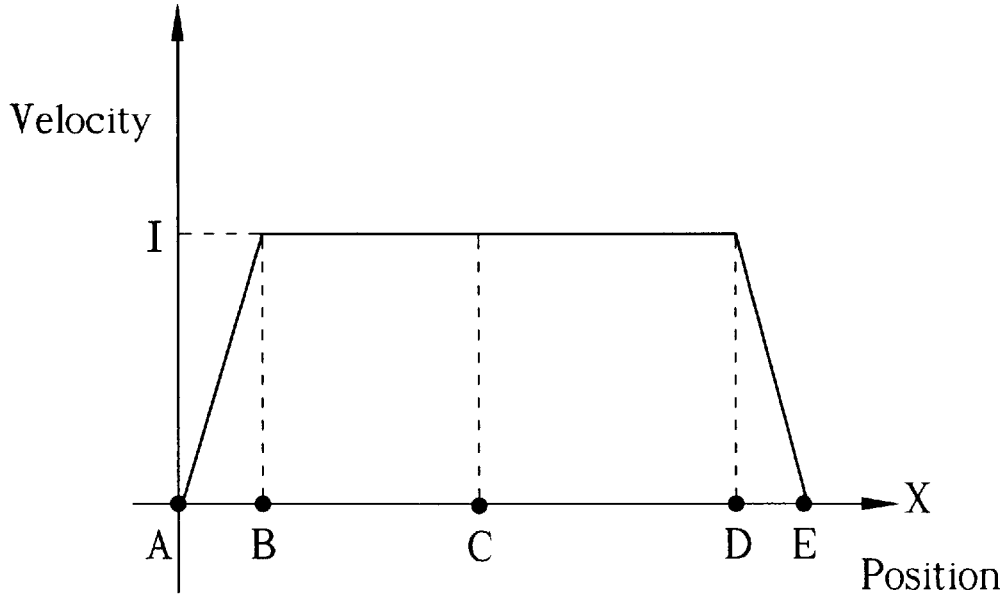
Fig. 3 Prior art
FIG. 3 is a relationship diagram showing a velocity dependence on position of a print head of the printing device shown in FIG. 1.
Figure 4:
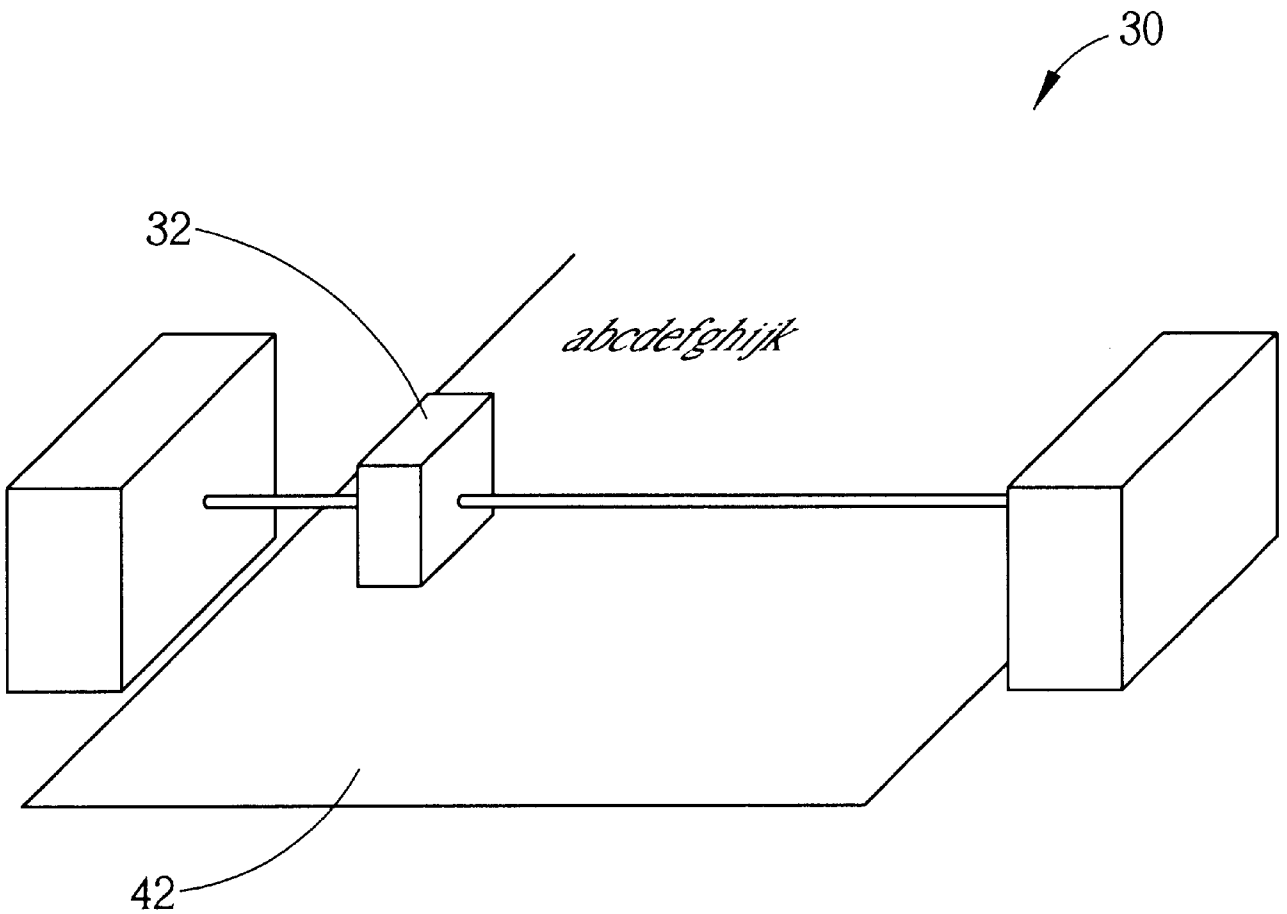
FIG. 4 is a perspective view of a printing device according to the present invention.
Figure 5:
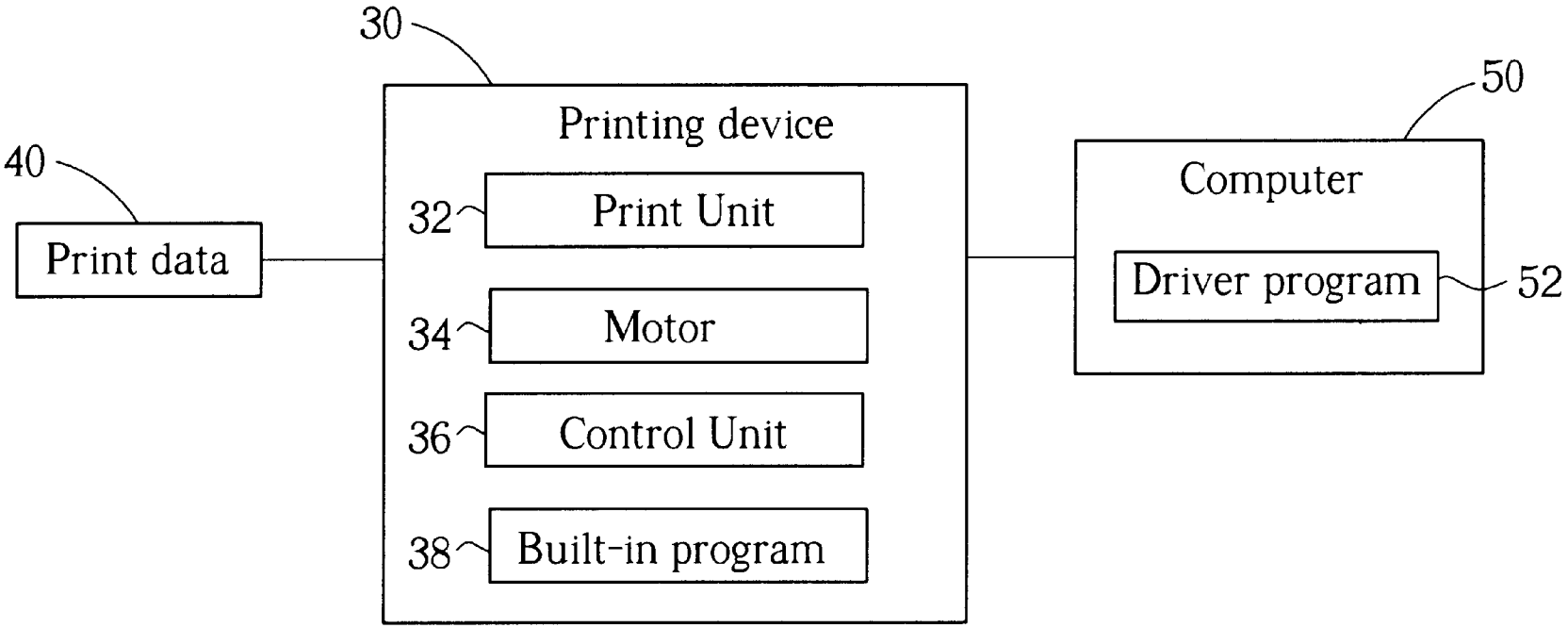
FIG. 5 is a block diagram showing the functions of the printing device shown in FIG. 4.

Please refer to FIG. 4 and FIG. 5. FIG. 4 is a perspective view of a printing device 30 according to the present invention. FIG. 5 is a block diagram that shows the functions of the printing device 30 shown in FIG. 4. The printing device 30 may be an ink printer or an ink-jet device. As shown in FIG. 5, a control unit 36 is used to control a print unit 32 that is driven by a motor 34 according to print data 40. The control unit 36 plays an important role in the present invention.

Figure 6:
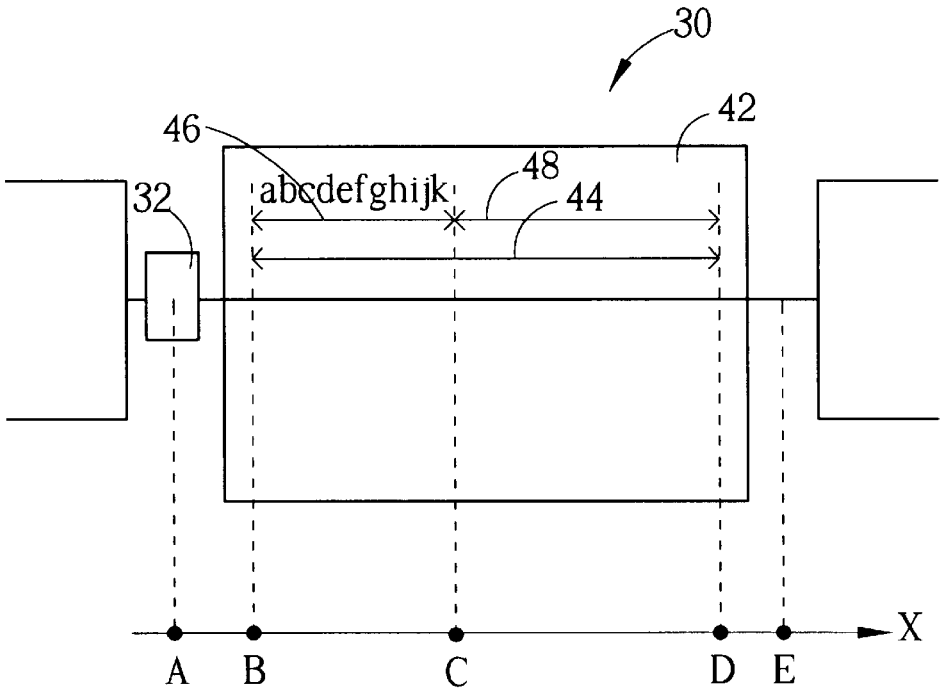
FIG. 6 is a top view of a first embodiment of the printing device shown in FIG. 4.

Please refer to FIG. 4, FIG. 5, and FIG. 6. FIG. 6 is a top view of a first embodiment of the printing device 30 shown in FIG. 4. The control unit 36 controls the print unit 32 for going left and right between position A and position E along the X-direction for performing a plurality of printing procedures. While the printing device 30 prints a document 42, the print unit 32 goes from position A to position E to perform the first printing procedure. For performing the second procedure, the print unit 32 comes from the position E back to the position A. These two motions will continue until the document 42 is printed completely. The document 42 is printed in such a bi-directional printing procedure that the print unit 32 goes from A to E in each of the odd procedures and goes from E to A in each of the even procedures.

In addition to the bi-directional printing procedure in the first embodiment, the printing procedure according to the present invention may be a one-way printing procedure with the print unit 32 going from A to E in each printing procedure, or any other middle points between the point A and the point E may be chosen as a starting point or an ending point in each printing procedure.

Figure 7:
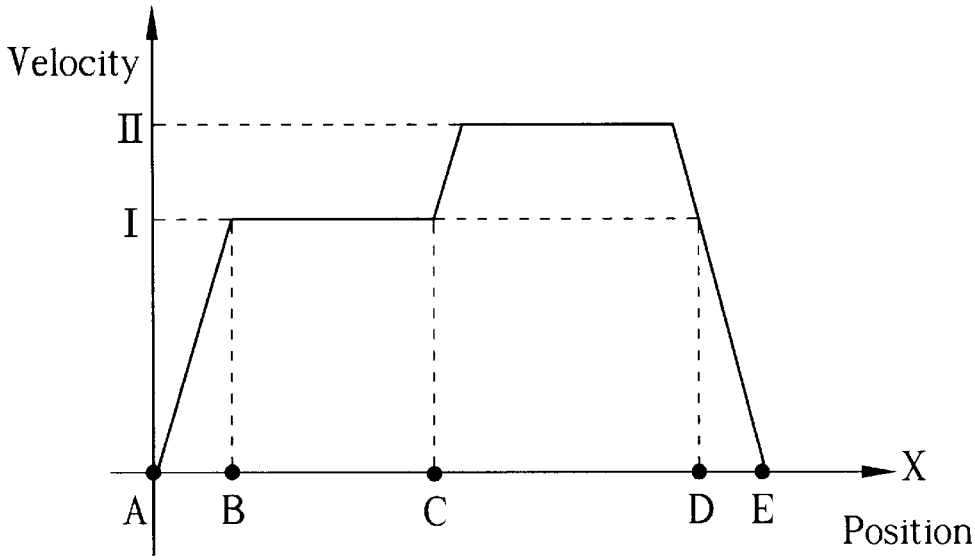
FIG. 7 is a relationship diagram showing a velocity dependence on position of a print unit of the printing device shown in FIG. 6.

Please refer to FIG. 7, of a relationship diagram showing the velocity dependence on position of a print unit 32 of the printing device 30 shown in FIG. 6. In each of the odd printing procedures, the control unit 36 controls the print unit 32 to accelerate from position A to position B and to decelerate from position D to position E. In each even printing procedure, the control unit 36 controls the print unit 32 to accelerate from position E to position D and to decelerate from position B to position A. The velocity of the print unit 32 at positions A and E is zero.

The control unit 36 is also able to divide a print path 44 into two divisions according to the print data 40, a printing division 46 and a non-printing division 48 as shown in FIG. 6. The printing division 46 is a portion of the path 44. In that portion, the control unit 36 controls the print unit 32 to do a printing action. In an ink printer, for example, a printing action means that the print head injects ink on a document. The non-printing division 48 is a portion that excludes the printing division 46 from the print path 44. According to the print data, the control unit 36 can separate at least a printing division 46 from the print path 44, determine if the print path 44 includes a non-printing division 48, and determine if the non-printing division 48 is long enough.

According to the length and location of the non-printing division 48, the control unit 36 determines the moving velocity of the print unit 32 in the non-printing division 48. If the length of the non-printing division 48 is longer than or equal to a predetermined length, so that the length is long enough for the print unit 32 to accelerate, the control unit 36 will control the print unit 32 to move at a second velocity (velocity II) in the non-printing division 48. As shown in FIG. 7, the second velocity is higher than a first velocity (velocity I). Otherwise, if the length of the non-printing division 48 is not long enough for the print unit 32 to accelerate, the control unit 36 will control the print unit 32 to move at the first velocity rather than the second velocity. The printing device 30 performs the determinations described above according to the print data 40 until the document 42 is printed completely.

Figure 8:
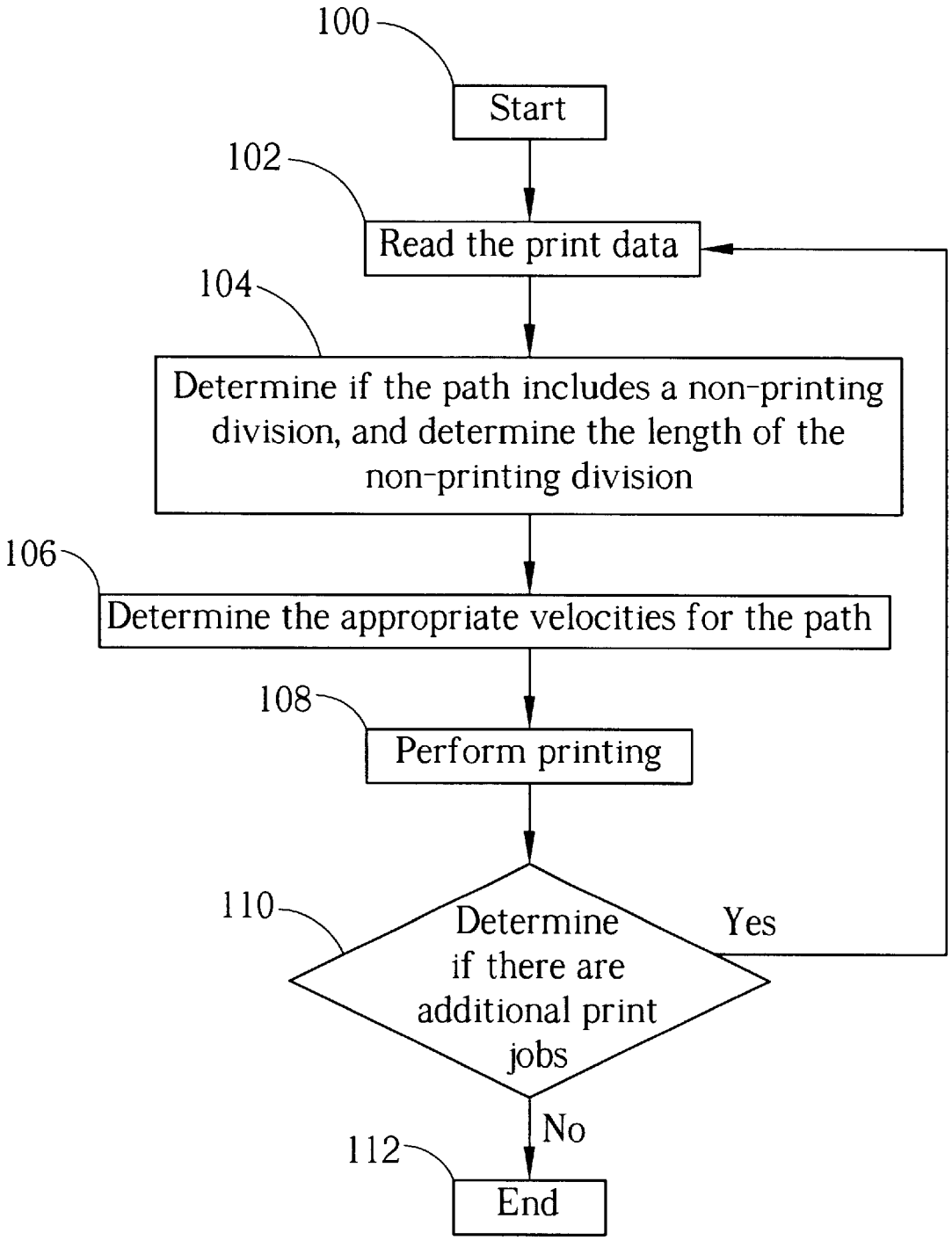
FIG. 8 is a flow chart of the printing device shown in FIG. 6.

Please refer to FIG. 8, of a flow chart of the printing device 30 shown in FIG. 6. The method according to the first embodiment comprises:

Step 100: Start;

Step 102: Read the print data 40;

Step 104: In each printing procedure, separate at least a printing division from the path 44, determine if the path includes a non-printing division 48, and determine the length of the non-printing division 48 according to the print data;

Step 106: Determine the moving velocity of the print unit 32. Control the print unit 32 to move at a first velocity and to print the document within the printing division 46 when the print unit 32 passes through the printing division 46; and if the path is long enough to include the non-printing division 48, control the print unit to stop printing the document and move at a second velocity within the non-printing division 48 when the print unit 32 passes through the non-printing division 48;

Step 108: Perform printing;

Step 110: Determine if there are additional printing jobs. If so, go to step 102. If not, continue to step 112;

Step 112: End.

In summary, the control unit 36 can control the print unit 32 to move at the first velocity within the printing division, to move at the second velocity within the non-printing division if the non-printing division is long enough, and keep the first velocity within the non-printing division if the non-printing division is not long enough. It should be emphasized that the second velocity is not necessarily a constant velocity. The only requirement is that the second velocity is higher than the first velocity. Thus, the printing time spent by the print unit 32 according to the present invention is shorter than the printing time spent according to the prior art.

The first embodiment described above is an example of the printing division 46 locating at the beginning position of the print path 44. Another example is the printing division 46 located at positions other than the beginning position of the print path 44. This case will be illustrated in the second and third embodiments of the present invention.

Figure 9:
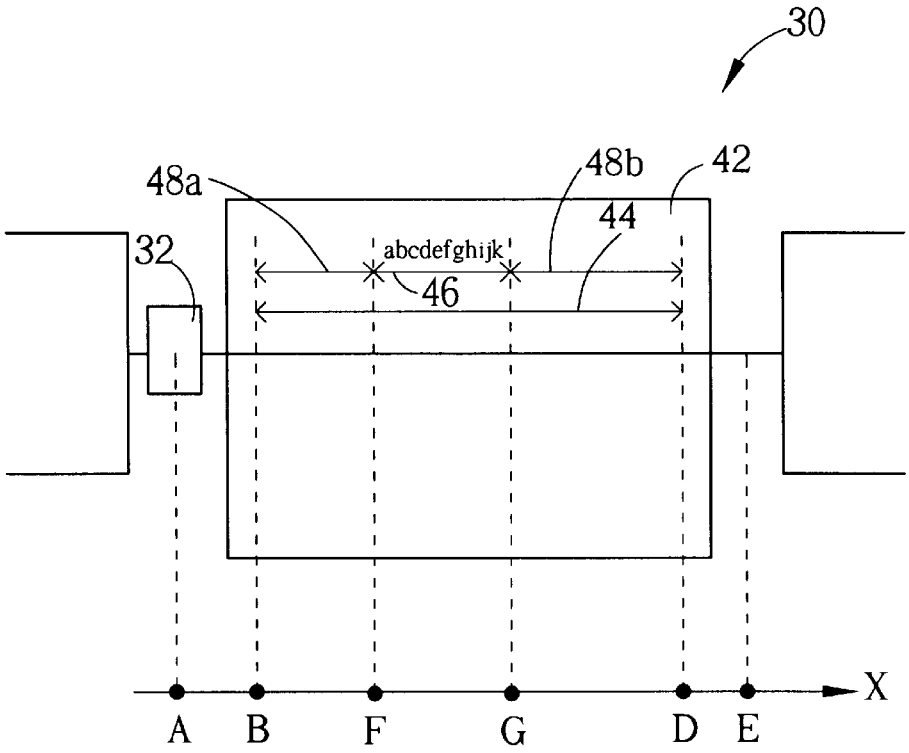
FIG. 9 is a top view of a second embodiment of the printing device shown in FIG. 4.
Figure 10:
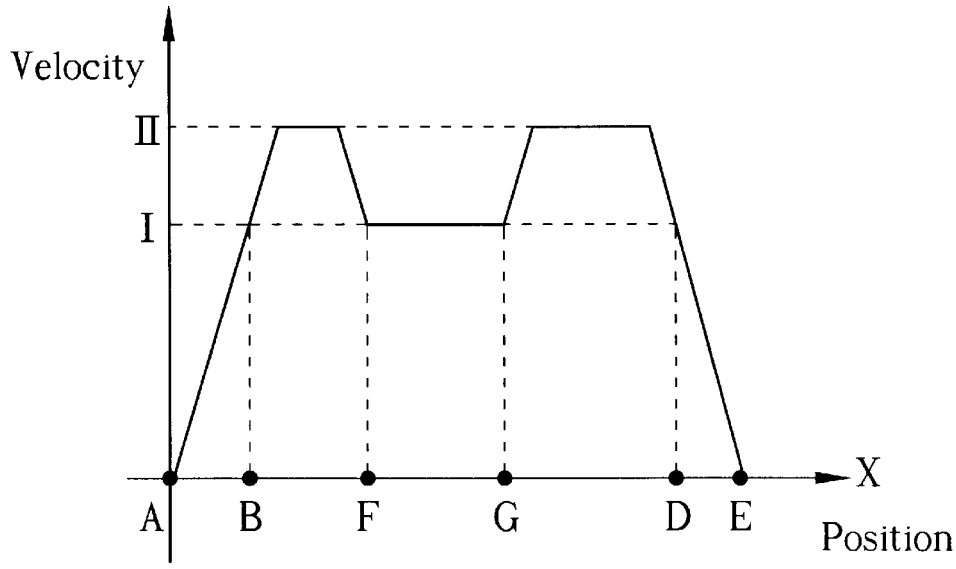
FIG. 10 is a relationship diagram showing a velocity dependence on position of a print unit of the printing device shown in FIG. 9.

Please refer to FIG. 9 and FIG. 10. FIG. 9 is a top view of a second embodiment of the printing device 30 shown in FIG. 4. FIG. 10 is a relationship diagram that shows the velocity dependence on position of a print unit 32 of the printing device 30 shown in FIG. 9. In this second embodiment, the printing division 46 is located in the middle portion of the print path 44. One of the non-printing divisions 48*a* is located at the beginning of the print path 44, with the other of the non-printing divisions 48*b* located after the printing division 46. As shown in the FIG. 10, the moving velocity in the non-printing division 48*a* is the same as the moving velocity in the non-printing division 48*b*. However, the moving velocity in 48*a* is not necessarily the same as the moving velocity in 48*b*. What is required is that the moving velocity in any non-printing division should be higher than the moving velocity in the printing division. That is, the moving velocities in all of the non-printing divisions are not necessarily the same, and not necessarily a constant velocity in each of the non-printing divisions.

Figure 11:
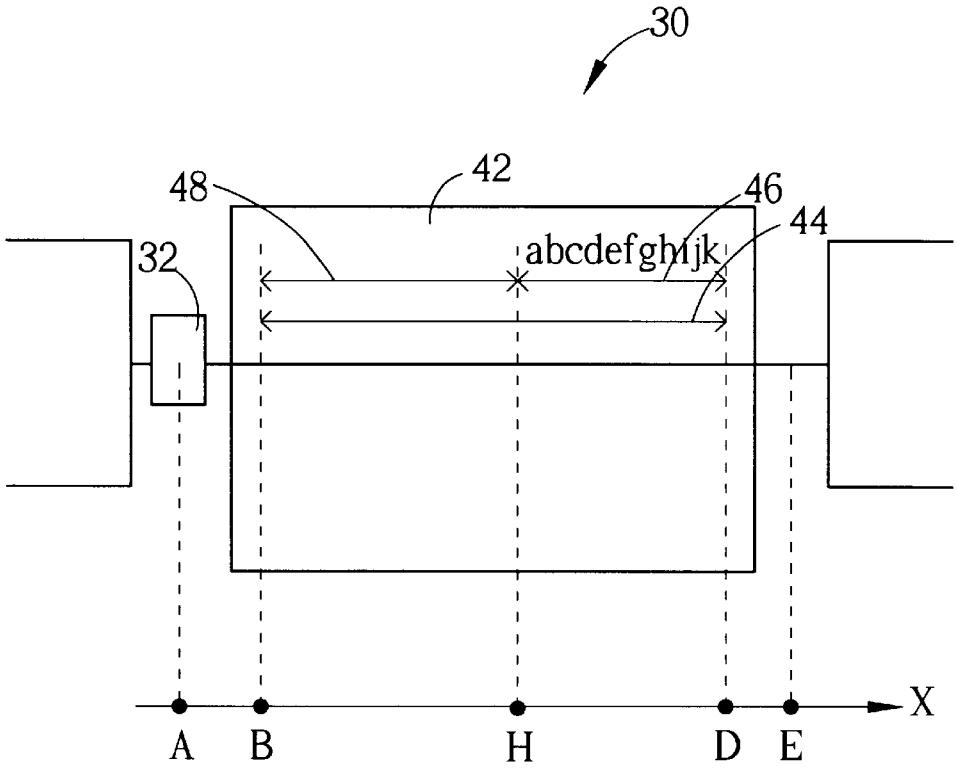
FIG. 11 is a top view of a third embodiment of the printing device shown in FIG. 4.
Figure 12:
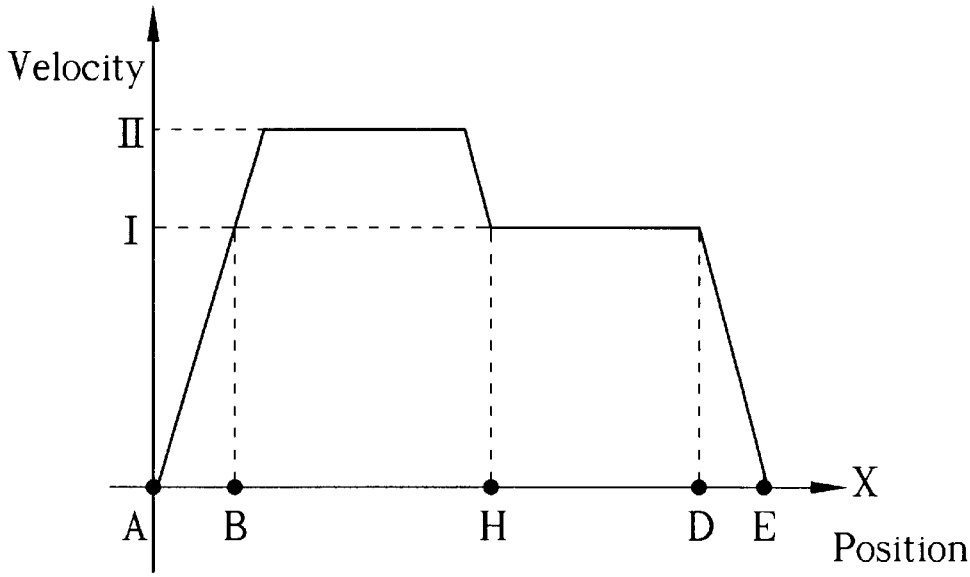
FIG. 12 is a relationship diagram showing a velocity dependence on position of a print unit of the printing device shown in FIG. 11.

Please refer to FIG. 11 and FIG. 12, FIG. 11 is a top view of a third embodiment of the printing device 30 shown in FIG. 4. FIG. 12 is a relationship diagram that shows the velocity dependence on position of the print unit 32 of the printing device 30 shown in FIG. 11. In this third embodiment, the printing division 46 is located after the non-printing division 48. As shown in the FIG. 12, the moving velocity II in the non-printing division 48 is still higher than the moving velocity I in the printing division 46, even though the non-printing division 48 is located at the beginning position of the print path 44.

In each of the three embodiments described above, the control unit 36 determines that if a non-printing division is included in the print path and if the length of the non-printing division is long enough, what the moving velocities in the non-printing division will be. However, these determinations may be performed by other ways. Please refer to FIG. 5 again. One of the possible ways is that the printing device 30 comprises a built-in program 38 and all the determinations will be performed by the built-in program 38. Another possible way is that the printing device 30 is connected to a computer 50 that comprises a driver program 52 and all the determinations mentioned above will be performed by the driver program 52.

In contrast to the prior art, the present invention provides a printing method and device so that a print unit moves at a first velocity within a printing division. The print unit moves at a higher velocity within a non-printing division if the non-printing division is included in the print path and is long enough, and uses the first velocity within the non-printing division if the non-printing division is not long enough. This results in speeding up the printing process while maintaining the quality of printing.

Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A printing device for performing a plurality of printing procedures according to print data so as to print a document, the printing device comprising:

a print unit for printing the document along a left-and-right direction;

a motor for driving the print unit left and right; and a control unit for controlling the velocity of the print unit; wherein before the printing device performs each of the printing procedures, the control unit separates at least a printing division as determined by the print data from a path that the print unit passes through in the printing procedure, and determines if the path includes a non-printing division as determined by the print data, and when the print unit passes through the printing division, the print unit prints the document and moves at a first velocity, and when the print unit passes through the non-printing division, the print unit stops printing the document and the control unit controls the print unit to move at a second velocity within the non-printing division, the second velocity being greater than the first velocity.

2. The printing device of claim 1 wherein the non-printing division is greater than or equal to a predetermined length.

3. The printing device of claim 1 wherein the non-printing division is greater than or equal to a predetermined length, and the control unit accelerates the print unit up to the second velocity and then moves the print unit at the second velocity within the non-printing division.

4. The printing device of claim 1 wherein the printing device is capable of bi-directional printing.

5. The printing device of claim 1 wherein the printing device is capable of single-directional printing.

6. The printing device of claim 1 further comprising a built-in program for controlling the velocity of the print unit within the non-printing division.

7. The printing device of claim 1 wherein the printing device is electrically connected to a computer, the computer comprising a driver program for controlling the velocity of the print unit within the non-printing division.

8. A method for speeding up a printing process of a printing device, the printing device comprising a print unit for performing a plurality of printing procedures according to print data so as to print a document, the method comprising:

in each printing procedure, separating at least a printing division as determined by the print data from a path that the print unit passes through in the printing procedure, and determining if the path includes a non-printing division as determined by the print data;

controlling the print unit to move at a first velocity and print the document when the print unit passes through the printing division; and if the path includes the non-printing division, controlling the print unit to stop printing the document and to move at a second velocity within the non-printing division when the print unit passes through the non-printing division, the second velocity being greater than the first velocity.

9. The method of claim 8 wherein the non-printing division is greater than or equal to a predetermined length.

10. The method of claim 8 wherein the non-printing division is greater than or equal to a predetermined length, the print unit accelerates up to the second velocity, and then moves at the second velocity within the non-printing division.

11. The method of claim 8 wherein the printing device is capable of bi-directional printing.

12. The method of claim 8 wherein the printing device is capable of single-directional printing.

13. The method of claim 8 wherein the printing device is an ink-jet device.

14. The method of claim 8 wherein the printing device further comprises a built-in program for controlling the velocity of the print unit within the non-printing division.

15. The method of claim 8 wherein the printing device is electrically connected to a computer, the computer comprising a driver program for controlling the velocity of the print unit within the non-printing division.

* * * * *